US009854887B2

(12) United States Patent
Yu

(10) Patent No.: US 9,854,887 B2
(45) Date of Patent: Jan. 2, 2018

(54) ROLLING BACKPACK

(71) Applicant: Luggage America, Carson, CA (US)

(72) Inventor: Chris Yu, Carson, CA (US)

(73) Assignee: OLYMPIA INTERNATIONAL, INC., Torrance, CA (US)

( * ) Notice: Subject to any disclaimer, the term of this patent is extended or adjusted under 35 U.S.C. 154(b) by 0 days.

(21) Appl. No.: 14/945,225

(22) Filed: Nov. 18, 2015

(65) Prior Publication Data

US 2017/0055658 A1 Mar. 2, 2017

(30) Foreign Application Priority Data

Aug. 27, 2015 (KR) ..... 20-2015-0005726 U

(51) Int. Cl.

| | |
|---|---|
| ***A45F 4/00*** | (2006.01) |
| ***A45F 3/04*** | (2006.01) |
| ***A45C 9/00*** | (2006.01) |
| ***A45F 4/02*** | (2006.01) |
| ***A45C 13/10*** | (2006.01) |
| ***A45C 5/14*** | (2006.01) |

(52) U.S. Cl.

CPC ..... *A45C 9/00* (2013.01); *A45C 5/14* (2013.01); *A45C 13/10* (2013.01); *A45C 13/103* (2013.01); *A45F 3/04* (2013.01); *A45F 4/02* (2013.01); *A45C 2009/007* (2013.01); *A45C 2013/1015* (2013.01)

(58) Field of Classification Search

CPC ..... A45F 3/04; A45F 4/02; A45C 9/00; A45C 5/14; A45C 13/10; A45C 2013/1015; A45C 2009/007

USPC ..... 224/153, 576; 190/18 A

See application file for complete search history.

(56) References Cited

U.S. PATENT DOCUMENTS

| | | | | | |
|---|---|---|---|---|---|
| 1,967,160 | A | * | 7/1934 | Piotkin | A45C 13/36 190/127 |
| D375,402 | S | * | 11/1996 | Yeh | 224/153 |
| 5,588,569 | A | * | 12/1996 | Mitomi | A45F 3/04 190/110 |
| 5,743,363 | A | * | 4/1998 | Rekuc | A45F 3/04 190/18 A |
| 5,749,503 | A | * | 5/1998 | Wulf | A45C 5/14 190/18 A |

(Continued)

FOREIGN PATENT DOCUMENTS

| | | | | | |
|---|---|---|---|---|---|
| JP | 09285329 | A | * | 11/1997 | A45F 3/04 |

*Primary Examiner* — Adam Waggenspack
*Assistant Examiner* — Lester L Vanterpool
(74) *Attorney, Agent, or Firm* — Lee, Hong, Degerman, Kang & Waimey

(57) ABSTRACT

Provided is a rolling backpack that may be carried over a user's shoulder with shoulder straps and also be pulled with wheels. The rolling backpack includes a receiving pocket for receiving shoulder straps in a back of a main body, dual wheels coupled to both sides of a lower portion of the main body via shafts and each comprising a pair of wheels, the wheels being integrally coupled to each other to be rotated in the same direction or the wheels being independent from each other to be rotated in the same direction or in different directions, a wheel cover coupled to a lower portion of the back of the main body and spread downwards to cover the wheels, and a protector coupled to the lower portion of the main body in such a way as to extend from a front to a side thereof.

12 Claims, 9 Drawing Sheets

(56) References Cited

U.S. PATENT DOCUMENTS

| | | | | | |
|---|---|---|---|---|---|
| 5,893,495 | A * | 4/1999 | Godshaw | A45C 5/14 | 190/115 |
| 5,984,154 | A * | 11/1999 | Scicluna | A45F 3/04 | 190/18 A |
| 6,305,587 | B1 * | 10/2001 | Miller | A45C 7/0068 | 224/153 |
| 6,530,507 | B2 * | 3/2003 | Oh | A45C 5/14 | 190/18 A |
| 6,550,651 | B1 * | 4/2003 | Murdoch | A45C 5/143 | 190/18 A |
| 6,592,012 | B2 * | 7/2003 | Godshaw | A45F 4/02 | 224/153 |
| 6,702,164 | B1 * | 3/2004 | De Lathouwer | A45C 5/14 | 190/115 |
| 6,742,684 | B2 * | 6/2004 | Oh | A45C 9/00 | 224/153 |
| 6,923,352 | B2 * | 8/2005 | Oh | A45C 5/14 | 190/1 |
| 7,617,956 | B1 * | 11/2009 | Sabbah | A45C 5/143 | 190/18 A |
| 8,292,136 | B2 * | 10/2012 | Tonelli | A45C 13/38 | 224/250 |
| 2002/0145018 | A1 * | 10/2002 | Godshaw | A45F 4/02 | 224/153 |
| 2003/0015559 | A1 * | 1/2003 | Oh | A45C 5/14 | 224/153 |
| 2003/0213821 | A1 * | 11/2003 | Oh | A45C 9/00 | 224/153 |
| 2006/0153477 | A1 * | 7/2006 | Koguchi | A45C 9/00 | 383/14 |

* cited by examiner

ROLLING BACKPACK

CROSS-REFERENCE TO RELATED APPLICATION

Pursuant to 35 U.S.C. §119(a), this application claims the benefit of earlier filing date and right of priority to Korean Patent Application No. 20-2015-0005726, filed on Aug. 27, 2015, the contents of which are all hereby incorporated by reference herein in its entirety.

BACKGROUND OF THE INVENTION

Field of the Invention

The present invention relates to a rolling bag that may also serve as a backpack, and more particularly, to a rolling backpack that may be carried over a user's shoulder with shoulder straps and also be pulled with wheels.

Description of the Related Art

In general, a backpack or knapsack is a container that is made of cloth or leather to put articles therein and carry the backpack or knapsack on a user's back. Moreover, the backpack is used to contain and carry articles such as clothes or camping equipment for travelling, hiking, skiing or the like, and is a travelling or hiking bag that usually has shoulder straps to allow it to be carried over a user's back.

A big backpack may contain a lot of articles therein. However, if the backpack contains a lot of articles and thus is heavy, it overstrains the shoulder, thus making a user tired and causing main parts of a body to be deformed. In order to solve the problem, wheels may be fixed to a bottom of the backpack to allow a user to pull the backpack.

Conventionally, if the backpack is carried using the wheels, it is difficult to deal with the shoulder straps. Further, while the backpack is carried using the wheels, the wheels may be contaminated, so that a user's clothes or the like may be stained with foreign matter of the wheels and may become dirty when he or she shoulders the backpack. While the backpack is pulled, a side of a lower portion of the backpack may be easily stained with the foreign matter. If the backpack comes into contact with or collides with a ground or an object, the lower portion of the backpack may be worn out or torn or a hole may be made in the lower portion of the backpack, thus undesirably causing damage to the backpack.

CITATION LIST

Patent Document

[Patent Document 1] Korean U.M. Registration Publication No. 20-0301092 (published on Jan. 24, 2003)

SUMMARY OF THE INVENTION

In order to solve the problems occurring in the related art, an aspect of the present invention is directed to a rolling backpack, which is configured such that shoulder straps are not exposed to the outside when the backpack is pulled using wheels provided on the backpack, and a lower portion of the backpack is not easily worn out by a ground or an external object.

Another aspect of the present invention is directed to a rolling backpack, which increases a contact area between wheels provided on both sides of the backpack and a ground, thus preventing the backpack from being turned over, minimizing a force for pulling the backpack, and making it easy to pull the backpack.

According to an embodiment of the present invention, a rolling backpack may include a receiving pocket for receiving shoulder straps in a back of a main body that has a predetermined capacity to receive an article therein; dual wheels coupled to both sides of a lower portion of the main body via shafts and each comprising a pair of wheels, the wheels being integrally coupled to each other to be rotated in the same direction or the wheels being independent from each other to be rotated in the same direction or in different directions; a wheel cover coupled to a lower portion of the back of the main body and spread downwards to cover the wheels; and a protector coupled to the lower portion of the main body in such a way as to extend from a front to a side thereof.

Further, the receiving pocket may include independent pockets to receive the respective shoulder straps therein.

Furthermore, a slide fastener or a "hook-and-loop fastener" or "touch fastener" such as VELCRO® tape may be provided to close or open an upper end of the receiving pocket.

Further, a space may be defined in the lower portion of the back of the main body so that the wheel cover may be folded backwards and stored.

A rolling backpack according to the present invention is advantageous in that a receiving part is formed on a back of the backpack to receive shoulder straps therein and thereby prevent the shoulder straps from being exposed to the outside when the backpack is pulled or stored, a robust protector is coupled to a lower portion of the backpack to prevent the backpack from being easily worn out when it comes into contact with a ground or an external object, dual wheels are applied to both sides of the lower portion of the backpack to increase a contact area with the ground and thereby prevent the backpack from being easily turned over, thus minimizing a force for pulling the backpack and making it easy to pull the backpack, and a wheel cover is provided between wheels and a user's back to prevent garments from being stained with foreign matter of the wheels when he or she shoulders the backpack, thus making it convenient to use the backpack.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF EXEMPLARY EMBODIMENTS

Figure 1:
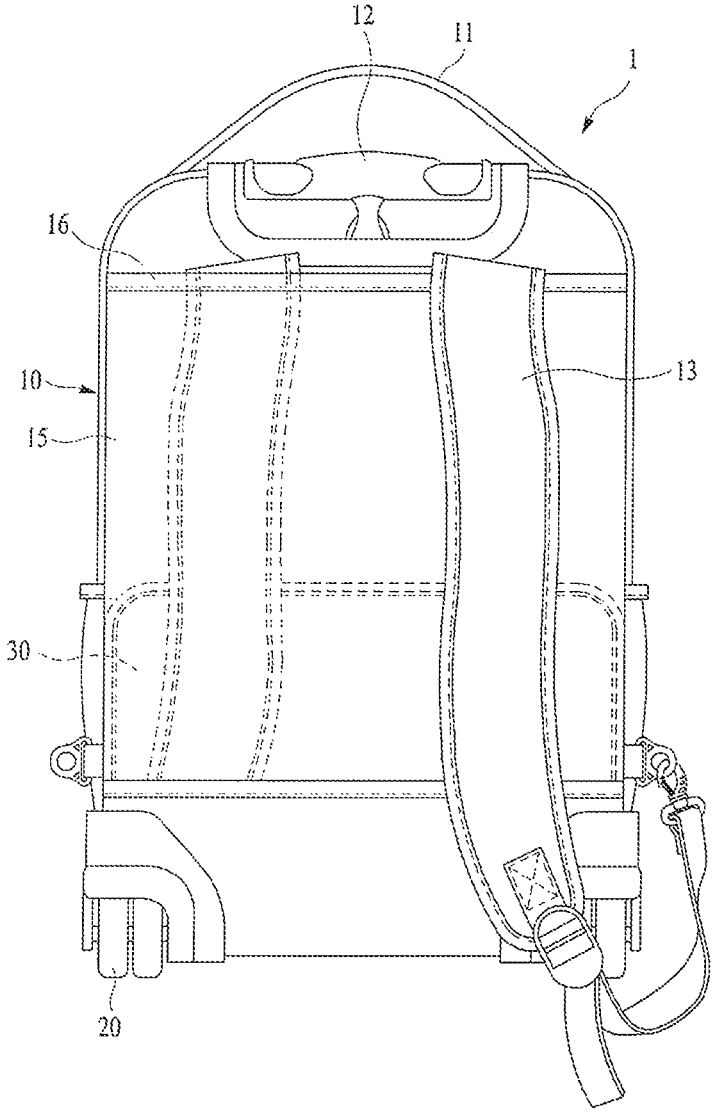
FIG. 1 is a rear view illustrating a rolling backpack according to an embodiment of the present invention, in which a shoulder strap is inserted into a receiving pocket of the rolling backpack.

Exemplary embodiments of the present invention will be described below in detail with reference to the accompanying drawings. Wherever possible, the same reference numerals will be used to refer to the same elements throughout the specification, and a duplicated description thereof will be omitted. It will be understood that although the terms "first", "second", etc. are used herein to describe various elements, these elements should not be limited by these terms. These terms are only used to distinguish one element from another element.

Hereinafter, a rolling backpack according to the present invention will be described in detail with reference to the accompanying drawings.

Referring to FIG. 1, a rolling backpack 1 includes a predetermined capacity of main body 10 to accommodate articles therein. One or more accommodation spaces are defined in each of an interior and an exterior of the main body 10. The main body 10 is made of one or more materials selected from cloth, synthetic resin or metal. Shoulder straps 13 are provided on a back of the main body 10 so that a user may carry the backpack over his or her shoulder using the shoulder straps 13, and a handle 11 is provided on an upper end of the main body 10 to pick up the backpack with the hand. Further, a pulling handle 12 coupled with a telescopic pulling rod is provided on the upper end of the main body 10 to pull the rolling backpack 1 using wheels.

Figure 2:
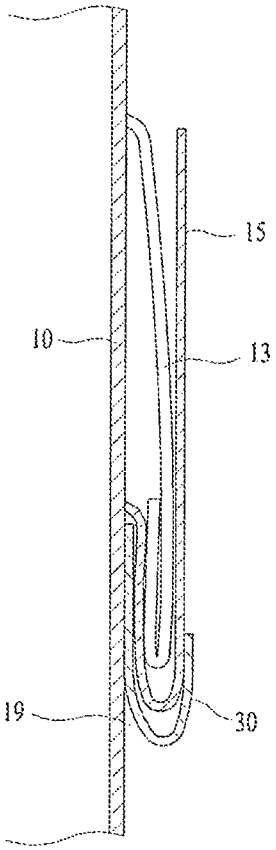
FIG. 2 is a sectional view illustrating the receiving pocket of the rolling backpack of FIG. 1.

FIG. 2 is a sectional view illustrating a receiving pocket 15 of the rolling backpack 1. A lower end of the receiving pocket 15 is folded to the back of the rolling backpack 1 and the inside of the receiving pocket 15 by a predetermined length and then is secured to the back of the rolling backpack 1. That is, the receiving pocket 15 is opened at an upper end thereof and is closed at the lower end thereof. Further, a space 19 is defined between an inside of a lower portion of the receiving pocket 15 and the back of the rolling backpack 1, and a wheel cover 30 is inserted into the space 19. The wheel cover 30 is inserted into or separated from the space 19.

Figure 3:
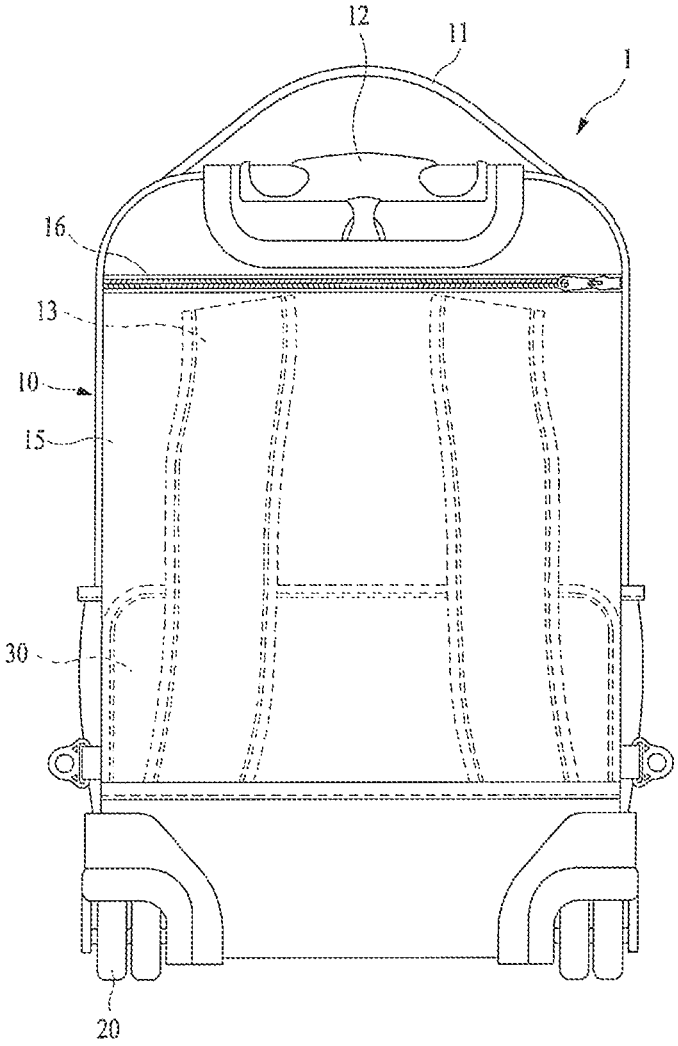
FIGS. 3 and 4 are rear views illustrating a rolling backpack according to another embodiment of the present invention, in which a slide fastener is applied to a receiving pocket of the rolling backpack.

Referring to FIG. 3, the receiving pocket 15 is used to receive the shoulder straps 13 in the back of the main body 10. A slide fastener 16 is attached to the upper end of the receiving pocket 15 to close or open the receiving pocket 15. That is, when a user carries the rolling backpack 1 using the handle 11 or pulls it using the pulling handle 12, the shoulder straps 13 may unnecessary and be even cumbersome. Hence, after the shoulder straps 13 are put into the receiving pocket 15, it may be closed using the slide fastener 16 that is provided on the upper end of the receiving pocket 15 and the back of the rolling backpack 1 corresponding thereto. Therefore, the shoulder straps 13 of the rolling backpack 1 are not exposed to the outside, so that it is possible to safely use the rolling backpack 1.

Figure 4:
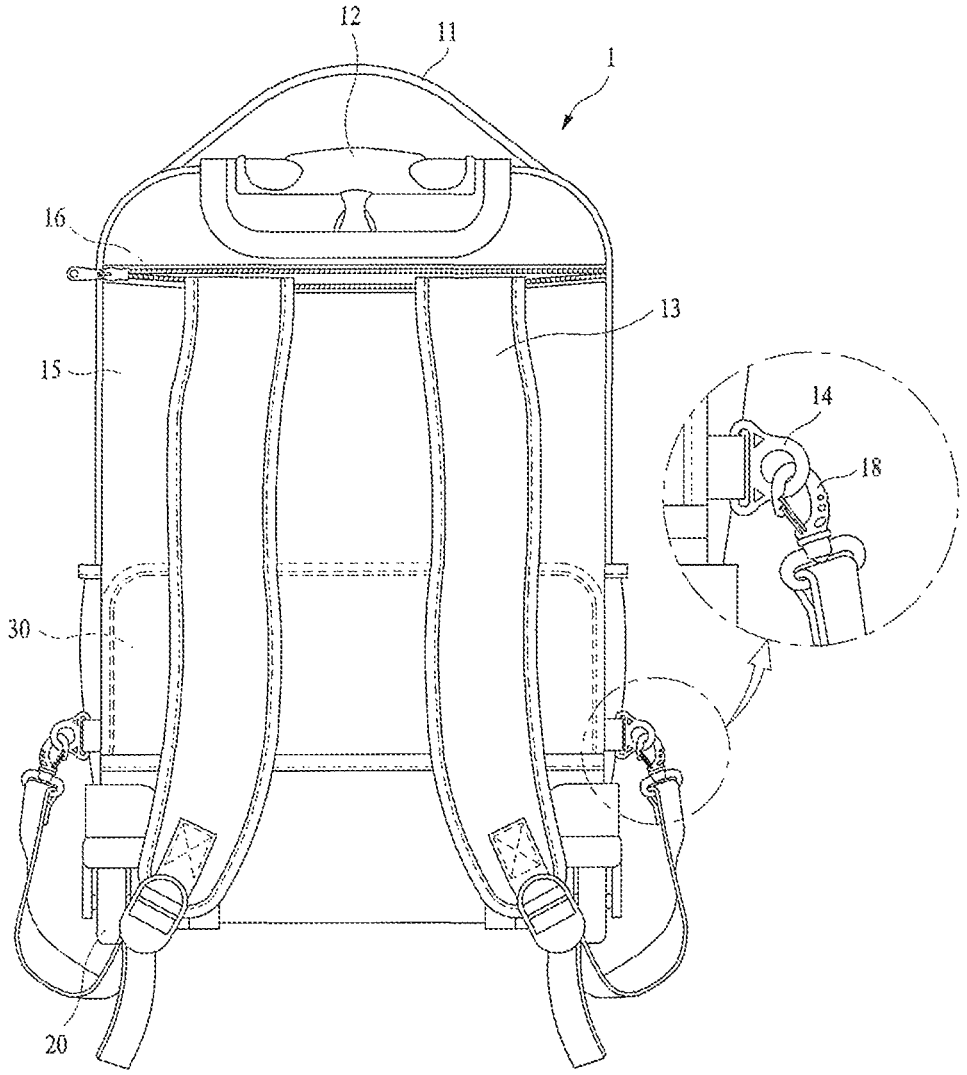

FIG. 4 shows a state where the shoulder straps 13 are taken out from the receiving pocket 15. A carabiner 18 or a snap ring coupled to an end of each shoulder strap 13 is coupled to a ring 14 that is provided on a side of the main body 10. The carabiner 18 is provided with a dual locking bar so that the carabiner 18 is not easily separated from the ring 14.

Figure 5:
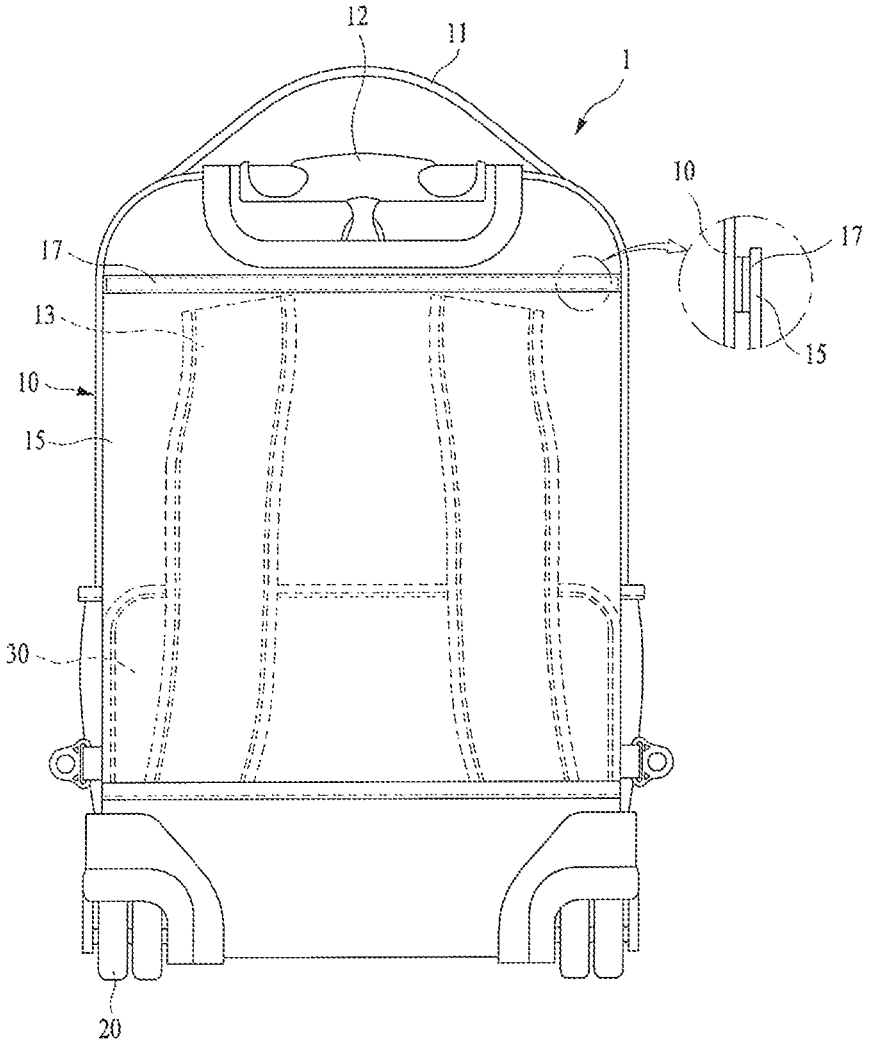
FIG. 5 is a rear view illustrating a rolling backpack according to a further embodiment of the present invention, in which a VELCRO® tape is applied to a receiving pocket of the rolling backpack.

Further, referring to FIG. 5, a VELCRO® tape 17 is attached to the upper end of the receiving pocket 15 to close or open the receiving pocket 15. That is, when a user carries the rolling backpack 1 using the handle 11 or pulls it using the pulling handle 12, the shoulder straps 13 may be unnecessary and be even cumbersome. Hence, after the shoulder straps 13 are put into the receiving pocket 15, it may be closed using the VELCRO® tape 17 that is provided on the upper end of the receiving pocket 15 and the back of the rolling backpack 1 corresponding thereto. Therefore, the shoulder straps 13 of the rolling backpack 1 are not exposed to the outside, so that it is possible to safely use the rolling backpack 1.

Figure 6:
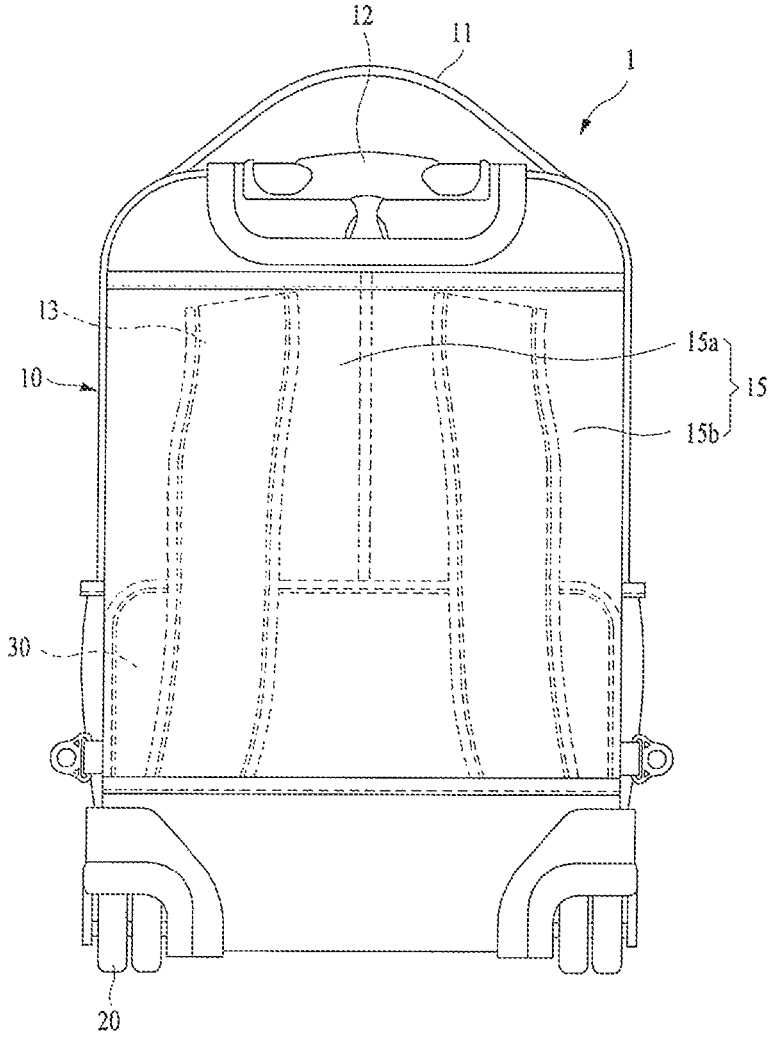
FIG. 6 is a rear view illustrating the rolling backpack according to the present invention, in which the receiving pocket is divided into desired portions.

Furthermore, as shown in FIG. 6, the receiving pocket 15 may be composed of independent pockets 15*a* and 15*b* that receive the respective shoulder straps 13. That is, the receiving pocket 15 is vertically divided to receive left and right shoulder straps 13 in the corresponding pockets 15*a* and 15*b*, respectively, thus preventing the shoulder straps 13 from being twisted or overlapping each other.

Figure 7:
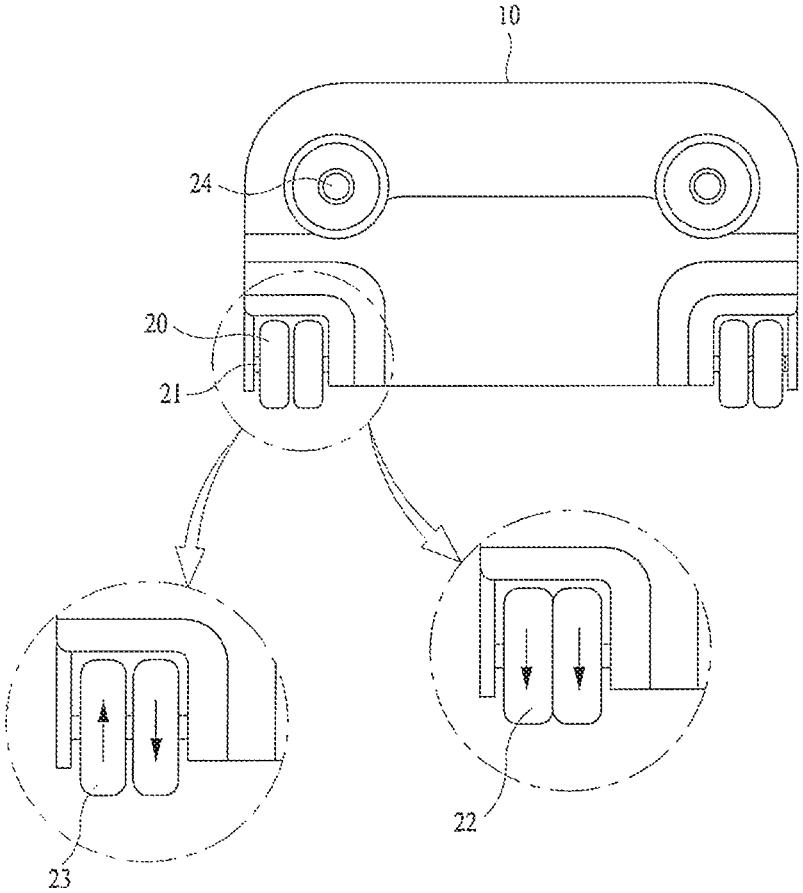
FIG. 7 is a view illustrating the structure of wheels mounted on the rolling backpack according to the present invention.

Referring to FIG. 7, dual wheels 20 are provided on both sides of the lower portion of the main body 10, each dual wheel 20 having a pair of wheels 20 that are coupled to each other via a shaft 21. The dual wheel 20 may comprise a pair of wheels that are integrally coupled to each other to rotate in the same direction, or may comprise a pair of wheels that are independent from each other to rotate in the same direction or different directions. That is, wheels 22 integrally coupled to the shaft 21 are rotated in the same direction, while wheels 23 independently coupled to the shaft 21 are rotate in different directions. Thus, the dual wheels 20 increase a contact surface with the ground to prevent the rolling backpack 1 from being easily tilted or falling. Further, the dual wheels 20 serve to disperse a weight of the rolling backpack 1 and minimize a frictional force with the ground.

Figure 8:
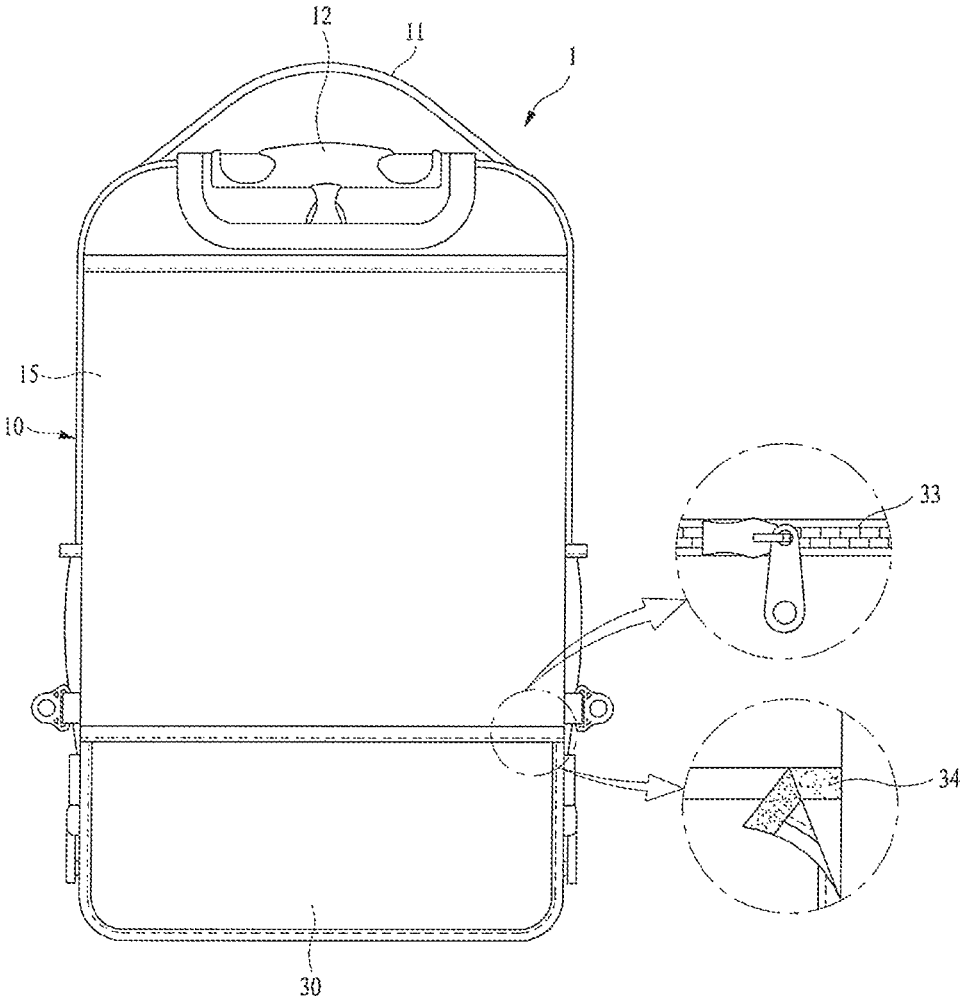
FIG. 8 is a view illustrating a wheel cover provided on the rolling backpack according to the present invention.

Referring to FIG. 8, the wheel cover 30 is provided on the lower portion of the back of the main body 10, namely, the lower end of the receiving pocket 15, and is unfolded downwards to cover the dual wheels 20 or is folded upwards to be put into the space 19 between the back of the main body 10 and the receiving pocket 15. The wheel cover 30 is made of cloth in such a way as to be folded upwards or unfolded downwards. Moreover, the upper end of the wheel cover 30 may be detachably coupled to the lower end of the receiving pocket 15 via a slide fastener 33, a VELCRO® tape 34 or the like. Further, a VELCRO® tape may be provided on a surface of the wheel cover 30 to be attached to an inside of the space corresponding thereto.

Figure 9:
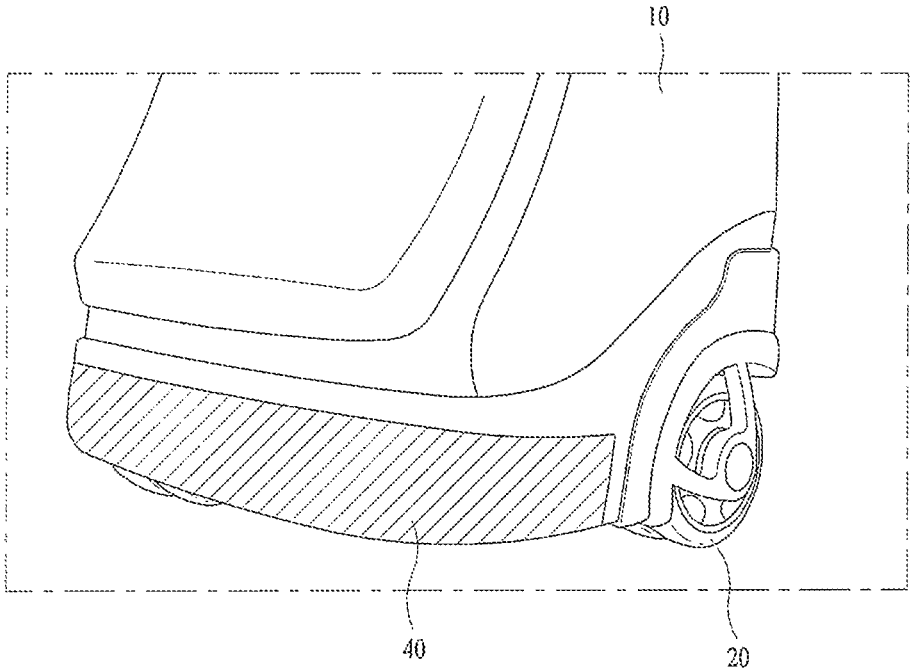
FIG. 9 is a view illustrating a protector provided on a lower portion of the rolling backpack according to the present invention.

Referring to FIG. 9, a protector 40 is coupled to the lower portion of the main body 10 to extend from a front to a side thereof. The protector 40 serves to protect the main body 10 so that it does not collide with an object protruding from the ground and is scratched by a wall or the like while a user pulls the rolling backpack 1. The protector 40 may be preferably made of a hard material, for example, urethane or leather. Moreover, the protector 40 makes it easy to clean the rolling backpack 1 when dirt or foreign matter on the ground sticks to the lower portion of the rolling backpack 1. Further, the protector or a member having a predetermined thickness should also be coupled to a bottom of the main body 10. A plurality of protrusions is provided on the bottom of the main body 10 to support the rolling backpack 1 in cooperation with the dual wheels 20 when the rolling backpack 1 is erected on the ground.

An operation of the rolling backpack according to the present invention configured as such will be described below.

First, when a user carries the rolling backpack 1 over his or her shoulder, the shoulder straps 13 coupled to the back of the main body 10 in such a way as to extend from an upper position to a lower position are used. If the shoulder straps 13 are inserted into the receiving pocket 15, it is possible to take the shoulder straps 13 out from the receiving pocket 15 through the open upper end of the receiving pocket 15. Further, in the case that the slide fastener 16 is attached to the receiving pocket 15, the slide fastener 16 is opened. In the case that the VELCRO® tape 17 is attached to the upper end of the receiving pocket 15, the VELCRO® tape 17 is opened. Then, the shoulder straps 13 are taken out from the receiving pocket 15. The lower end of each shoulder strap 13 is fixedly connected to the ring 14 between the back and the side of the main body 10. Thus, a user may carry the rolling backpack 1 over the shoulder using the shoulder straps 13 that are separated from the receiving pocket 15.

When a user carries the rolling backpack 1 over his or her shoulder, the wheel cover 30 is taken out from the space 19 that is defined in the lower portion of the back of the main body 10 and then is spread downwards. That is, if the dual wheels are stained with foreign matter while a user pulls the rolling backpack 1, the dual wheels 20 may come into contact with his or her back and thus garments may become dirty. Hence, the wheel cover 30 is spread to prevent the dual wheels 20 from coming into direct contact with the garments.

Further, when a user picks up the rolling backpack 1 by the handle 11 or pulls the rolling backpack 1 by the dual wheels 20 after holding the pulling handle 12, it is possible to insert the shoulder straps 13 exposed to the back of the main body 10 into the receiving pocket 15. In the case that the slide fastener 16 or the VELCRO® tape 17 is provided on the upper end of the receiving pocket 15, the slide fastener 16 or the VELCRO® tape 17 is opened and then the shoulder straps 13 are inserted into the receiving pocket 15. Subsequently, a mouth of the receiving pocket 15 is closed by the slide fastener 16 or the VELCRO® tape 17. Further, if the wheel cover 30 is unfolded, it is folded up and fixedly inserted into the space 19 defined in the back of the main body 10.

When a user pulls the rolling backpack 1, the dual wheels 20 allow the rolling backpack 1 to be stably and flexibly moved on the ground. Further, the protector 40 coupled to the lower portion of the main body 10 may minimize damage to the rolling backpack 1 when it comes into contact with an external object or an object projecting from the ground.

While the invention has been shown and described with reference to exemplary embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A rolling backpack comprising:

a first receiving pocket formed on a back of a main body of the rolling backpack, wherein the first receiving pocket is configured to receive shoulder straps coupled to a connection point of an upper portion of the back into a first space formed within the first receiving pocket;

a fastener, wherein:

the first receiving pocket comprises a first opening that is formed linearly at a top end of the first receiving pocket;

the fastener is linearly formed at the top end of the first receiving pocket and permits opening and closing of the first opening;

the connection point is not located above the fastener;

dual wheels coupled to both sides of a lower portion of the main body via shafts, each of the dual wheels comprising a pair of wheels;

a second receiving pocket formed on the back of the main body, the second receiving pocket comprising a second opening; and a wheel cover coupled to a lower portion of the back or coupled to a lower end of the first receiving pocket, wherein the wheel cover is configured to be:

pulled out of a second space formed within the second receiving pocket to be unfolded downwards to cover the dual wheels; and folded upwards through the second opening to be placed in the second space to expose the dual wheels, wherein:

the first receiving pocket further comprises a first section, a second section, and a bent section located between the first section and the second section, the bent section forming a bottom of the first receiving pocket at an opposite end of the first opening;

the second section of the first receiving pocket is longer than the first section of the first receiving pocket;

inner surfaces of the first, second, and bent sections and a first section of an outer surface of the back form the first space of the first receiving pocket;

an outer surface of the first section of the first receiving pocket and a second section of the outer surface of the back form the second space of the second receiving pocket;

the first section of the outer surface of the back is longer than the second section of the outer surface of the back;

the first section of the outer surface of the back and the inner surface of the first section of the first receiving pocket face the inner surface of the second section of the first receiving pocket when the shoulder straps are not placed within the first space of the first receiving pocket; and a protector coupled to the lower portion of the main body in such a way as to extend from a front portion of the lower portion of the main body to a side portion of the lower portion of the main body.

2. The rolling backpack of claim 1, wherein the first receiving pocket is vertically divided into two independent pockets such that each of the shoulder straps is received by a corresponding one of the two independent pockets.

3. The rolling backpack of claim 1, wherein the fastener comprises a slide fastener linearly attached to the upper end of the first receiving pocket or a hook and loop fastener tape provided linearly on the upper end of the first receiving pocket.

4. The rolling backpack of claim 1, further comprising:

a pulling handle formed on an upper end of the main body and coupled with a telescopic pulling rod, wherein the pulling handle is not enclosed within the first receiving pocket even when the pulling handle is not extended such that at least a portion of the pulling handle is always exposed.

5. The rolling backpack of claim 1, wherein the wheel cover is detachably coupled to the lower end of the first receiving pocket.

6. The rolling backpack of claim 5, wherein an upper end of the wheel cover is detachably coupled to the lower end of the first receiving pocket via a slide fastener or a hook and loop fastener.

7. The rolling backpack of claim 1, wherein the wheel cover is coupled to the lower portion of the back.

8. The rolling backpack of claim 1, wherein the wheel cover is coupled to the lower end of the first receiving pocket.

9. The rolling backpack of claim 8, wherein the wheel cover is detachably coupled to the lower end of the first receiving pocket via a slide fastener or a tape.

10. A rolling backpack comprising:

a receiving pocket formed on a back of a main body of the rolling backpack, wherein the receiving pocket is shaped to form a first space inside the receiving pocket and a second space outside the receiving pocket, the second space formed between the receiving pocket and the back;

shoulder straps, first ends of the shoulder straps coupled to an upper portion of the back and each of second ends of the shoulder straps having a first coupling structure that is configured to be detachably coupled to a second coupling structure formed on the main body;

wheels coupled to a lower portion of the main body;

a pulling handle formed on an upper end of the main body, the pulling handle coupled with a telescopic pulling rod; and a wheel cover coupled to a first side of a lower portion of the receiving pocket, wherein:

an opening of the receiving pocket is formed linearly along a top end line of the receiving pocket;

the upper portion of the back, to which the first ends of the shoulder straps are coupled, is located within the first space;

the pulling handle is not enclosed within the receiving pocket even when the pulling handle is not extended such that at least a portion of the pulling handle is always exposed regardless of whether the opening of the receiving pocket is open or closed;

the first space and the second space are separated by a second side of the lower portion of the receiving pocket;

the shoulder straps are configured to be received in the first space when the first coupling structure is not coupled with the second coupling structure such that one surface of the second side is in contact with the shoulder straps received in the first space;

the shoulder straps are configured to be pulled out of the first space for coupling of the first coupling structure with the second coupling structure;

the wheel cover is configured to be received in the second space when the wheel cover is folded upwards such that the other surface of the second side is in contact with the wheel cover received in the second space; and the wheel cover is configured to be pulled out of the second space to cover the wheels.

11. The rolling backpack of claim 10, wherein the shoulder straps and the wheel cover are not in contact with each other when the shoulder straps are placed in the first space and when the wheel cover is placed in the second space.

12. A rolling backpack comprising:

a receiving pocket formed on a back of a main body of the rolling backpack, wherein the receiving pocket is shaped to form a first space inside the receiving pocket and a second space outside the receiving pocket, the second space formed between the receiving pocket and the back;

shoulder straps, first ends of the shoulder straps coupled to an upper portion of the back and each of second ends of the shoulder straps having a first coupling structure that is configured to be detachably coupled to a second coupling structure formed on the main body;

wheels coupled to a lower portion of the main body;

a pulling handle formed on an upper end of the main body, the pulling handle coupled with a telescopic pulling rod; and a wheel cover coupled to a lower portion of the back, wherein:

an opening of the receiving pocket is formed linearly along a top end line of the receiving pocket;

the upper portion of the back, to which the first ends of the shoulder straps are coupled, is located within the first space;

the pulling handle is not enclosed within the receiving pocket even when the pulling handle is not extended such that at least a portion of the pulling handle is always exposed regardless of whether the opening of the receiving pocket is open or closed;

the shoulder straps are configured to be received in the first space when the first coupling structure is not coupled with the second coupling structure;

the shoulder straps are configured to be pulled out of the first space for coupling of the first coupling structure with the second coupling structure;

the wheel cover is configured to be received in the second space when the wheel cover is folded upwards;

the wheel cover is configured to be pulled out of the second space to cover the wheels; and the shoulder straps and the wheel cover are not in contact with each other when the shoulder straps are placed in the first space and when the wheel cover is placed in the second place.

* * * * *